US010875064B2

(12) United States Patent
Jiang et al.

(10) Patent No.: US 10,875,064 B2
(45) Date of Patent: Dec. 29, 2020

(54) ROLLING MILL

(71) Applicant: Baoshan Iron & Steel Co., Ltd., Shanghai (CN)

(72) Inventors: Zhengyi Jiang, Mount Ousley (AU); Xiawei Cheng, Dapto (AU); Jingwei Zhao, North Wollongong (AU); Bob de Jong, Kiama Downs (AU); Laizhu Jiang, Shanghai (CN); Suzhen Luo, Shanghai (CN); Jianguo Peng, Shanghai (CN); Ming Luo, Shanghai (CN); Li Ma, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 162 days.

(21) Appl. No.: 15/742,377

(22) PCT Filed: Jul. 7, 2015

(86) PCT No.: PCT/CN2015/083421
§ 371 (c)(1),
(2) Date: Jan. 5, 2018

(87) PCT Pub. No.: WO2017/004783
PCT Pub. Date: Jan. 12, 2017

(65) Prior Publication Data

US 2018/0193889 A1 Jul. 12, 2018

(51) Int. Cl.
*B21B 31/20* (2006.01)
*B21B 99/00* (2006.01)
(Continued)

(52) U.S. Cl.
CPC ..... *B21B 31/20* (2013.01); *B21B 45/004* (2013.01); *B21B 99/00* (2013.01); *H05B 3/0009* (2013.01); *H05B 3/023* (2013.01)

(58) Field of Classification Search
CPC ..... B21B 31/20; B21B 45/004; B21B 99/00; B21B 1/18; B21B 2001/225; B21B 1/26;
(Continued)

(56) References Cited

U.S. PATENT DOCUMENTS 1,145,880 A 7/1915 Clark
1,347,917 A * 7/1920 Sheperdson ..... B21B 45/004 72/202
(Continued)

FOREIGN PATENT DOCUMENTS

CN 204338569 U 5/2015
EP 0768124 A2 4/1997
JP H044910 A 1/1992

OTHER PUBLICATIONS

Machine Translation of CN 204338569 , EPO (Year: 2015).*
(Continued)

*Primary Examiner* — Edward T Tolan
(74) *Attorney, Agent, or Firm* — Seed IP Law Group LLP

(57) ABSTRACT

A rolling mill (1) which is suitable for performing hot stalling rolling includes: a housing (2); a first roller (9) mountable to the housing (2); a second roller (10) mountable to the housing (2), wherein the position of the second roller (10) relative to the housing (2) is adjustable, thereby adjusting the width of a roll gap (17) between the first roller (9) and the second roller (10), and wherein the roll gap (17) is configured to deform a workpiece (18) when the workpiece (18) is passed therethrough. The rolling mill provides the advantage of optimizing the rolling process.

15 Claims, 8 Drawing Sheets

(51) Int. Cl.
*H05B 3/00* (2006.01)
*B21B 45/00* (2006.01)
*H05B 3/02* (2006.01)

(58) Field of Classification Search
CPC ..... B21B 37/44; B21B 37/74; H05B 3/009; H05B 3/023; C21D 1/40; C21D 9/62
USPC ..... 72/200
See application file for complete search history.

(56) References Cited

U.S. PATENT DOCUMENTS 1,718,806 A * 6/1929 Witting ..... B21B 45/004 72/11.3
1,978,220 A * 10/1934 Otte ..... C21D 8/1222 148/108
3,124,982 A 3/1964 Neumann
3,228,220 A * 1/1966 Schneckenburger ..... B21B 1/16 72/8.5
3,247,697 A 4/1966 Cozzo
3,516,276 A 6/1970 Bond
3,988,914 A * 11/1976 Metcalfe ..... B21B 45/004 72/69
4,171,633 A 10/1979 Sebardt
5,832,765 A * 11/1998 Ohashi ..... B21B 1/18 72/40
5,942,132 A * 8/1999 Toyooka ..... B21C 37/0811 219/61.2
7,028,522 B2 * 4/2006 Kim ..... B21B 45/004 219/152
2009/0071261 A1 3/2009 Li et al.
2018/0193889 A1 * 7/2018 Jiang ..... B21B 31/20

OTHER PUBLICATIONS

Tieu et al., "An investigation into the tribological behavior of a work roll material at high temperature," *Wear*, 273, 2011, pp. 43-48.
International Search Report for PCT/CN2015/083421, dated Mar. 28, 2016, 4 pages.
Written Opinion of the International Searching Authority for PCT/CN2015/083421, dated Mar. 28, 2016, 5 pages.

* cited by examiner

ROLLING MILL

BACKGROUND

Technical Field

The present disclosure generally relates to a rolling mill and in particular to a rolling mill configured for use in a thermal-mechanical simulator and to a rolling mill suitable for performing hot stalling rolling.

Description of the Related Art

Simulation of the rolling process under laboratory conditions may be performed to study aspects of the rolling process and to perform trials which may be used to optimize the industrial rolling process. Thermal-mechanical simulators allow for the conditions of an industrial process to be simulated on a laboratory scale to help facilitate experimental trials that can more reliably predict the behavior of industrial processes. However, the test chambers of thermal-mechanical simulators are typically much smaller than a conventional laboratory rolling mill. The costs and difficulties associated with performing industrial trials on a rolling process makes it desirable to produce laboratory results that may be used to alter and optimize the industrial rolling process.

In a rolling process, oxide scale or lubricant present between the work rolls and a workpiece may significantly affect the interfacial friction and heat transfer conditions. These surface conditions can result in changes to the required roll forces, torques and power consumptions, as well as overall roll wear and surface quality of the rolled product.

Deformation of the work piece as it passes through the roll gap is a transient process dependent on various parameters. The surface conditions observed after a work piece has passed entirely through a roll gap displays only the final conditions, and not the transient conditions as the workpiece is being deformed by the rollers. To study the transient conditions of a workpiece, hot stalling rolling trials can be performed where the passage of the workpiece is halted before entirely passing through the roll gap. The resultant workpiece then includes rolled and unrolled portions, as well as partially rolled portion therebetween. Laboratory hot stalling rolling test can provide valuable data to help understand aspects of the rolling process which may help optimize the industrial rolling process.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavor to which this specification relates.

BRIEF SUMMARY

The present disclosure seeks to provide embodiments with improved features and properties.

According to a first aspect the present disclosure provides a rolling mill suitable for performing hot stalling rolling, including a housing; a first roller mountable to the housing; a second roller mountable to the housing, wherein the position of the second roller relative to the housing is adjustable, thereby adjusting the width of a roll gap between the first roller and the second roller, and wherein the roll gap is configured to deform a workpiece when the workpiece is passed therethrough.

According to a further aspect the present disclosure provides a rolling mill, wherein the first roller is fixed in position relative to the housing when mounted thereto.

According to a further aspect the present disclosure provides a rolling mill, wherein the housing includes a rear member with a cavity such that when the workpiece is passed through the roll gap, the workpiece protrudes into the cavity.

According to a further aspect the present disclosure provides a rolling mill, including two electrodes protruding from opposing portions of the housing thereby defining a space therebetween, wherein the space between the two electrodes is adjacent to the roll gap; wherein the space between the two electrodes is configured to receive a workpiece to complete a circuit between the two electrodes such that passing a current between the two electrodes causes the workpiece to heat.

According to a further aspect the present disclosure provides a rolling mill, wherein the electrodes heat the without the workpiece contacting the first roller or the second roller.

According to a further aspect the present disclosure provides a rolling mill, wherein the electrodes can heat the workpiece in excess of 1100° C.

According to a further aspect the present disclosure provides a rolling mill, wherein the first roller and the second roller include a shaft; and, a roller ring in the form of a hollow cylinder configured to rotate around the shaft.

According to a further aspect the present disclosure provides a rolling mill, wherein a space is provided between an inside surface of the roller ring and the shaft.

According to a further aspect the present disclosure provides a rolling mill, wherein one or more bearing elements are located between the shaft and the roller ring.

According to a further aspect the present disclosure provides a rolling mill, wherein the one or more bearing elements are located away from a center portion of the first and second roller.

According to a further aspect the present disclosure provides a rolling mill, wherein the center portion of the first and second roller is sufficiently sized to accommodate the workpiece.

According to a further aspect the present disclosure provides a rolling mill, wherein interfacial friction between the workpiece and the first and second roller ring will cause the first and second roller ring to rotate as the workpiece is moved through the roll gap; and, wherein the mass of the first and second roller ring is adapted such that when movement of the workpiece through the roll gap is paused, interfacial friction between the workpiece and the first and second roller ring will pause rotation of the first and second roller ring without substantial further rotation.

According to a further aspect the present disclosure provides a rolling mill, wherein the ratio of the inner diameter to the outer diameter of the first roller and the second roller is between about 0.7 and about 0.9.

According to a further aspect the present disclosure provides a rolling mill, wherein each end of the second roller is adapted with a mounting assembly and wherein each mounting assembly is configured to mount within a cavity in the housing.

According to a further aspect the present disclosure provides a rolling mill, wherein the mounting assembly includes a bushing mountable to the shaft of the second roller; one or more spacers adapted to removably locate between the bushing and a periphery of the cavity such that the position of the adjustable roller relative to the housing is adjustable by the one or more spacers.

According to a further aspect the present disclosure provides a rolling mill, including one or more locking pins configured to retractably extend into the cavity and assert a force to the bushing and the one or more spacers thereby fixing the bushing and the one or more spacers into position.

According to a further aspect the present disclosure provides a rolling mill, wherein the rolling mill is sized to reside within a test chamber of a thermal-mechanical simulator.

According to a further aspect the present disclosure provides a rolling mill, wherein the rolling mill includes a coupling adapted to connect with a first jaw of the thermal-mechanical simulator.

According to a further aspect the present disclosure provides a rolling mill, wherein the work piece is adapted to connect with a second jaw of the thermal-mechanical simulator.

According to a further aspect the present disclosure provides a rolling mill, wherein the thermal-mechanical simulator may control the motion of the first jaw and the second jaw, thereby passing the workpiece through the roll gap.

BRIEF DESCRIPTION OF THE SEVERAL VIEWS OF THE DRAWINGS

Example embodiments should become apparent from the following description, which is given by way of example only, of at least one preferred but non-limiting embodiment, described in connection with the accompanying figures.

PARTS LIST

Figure 1:
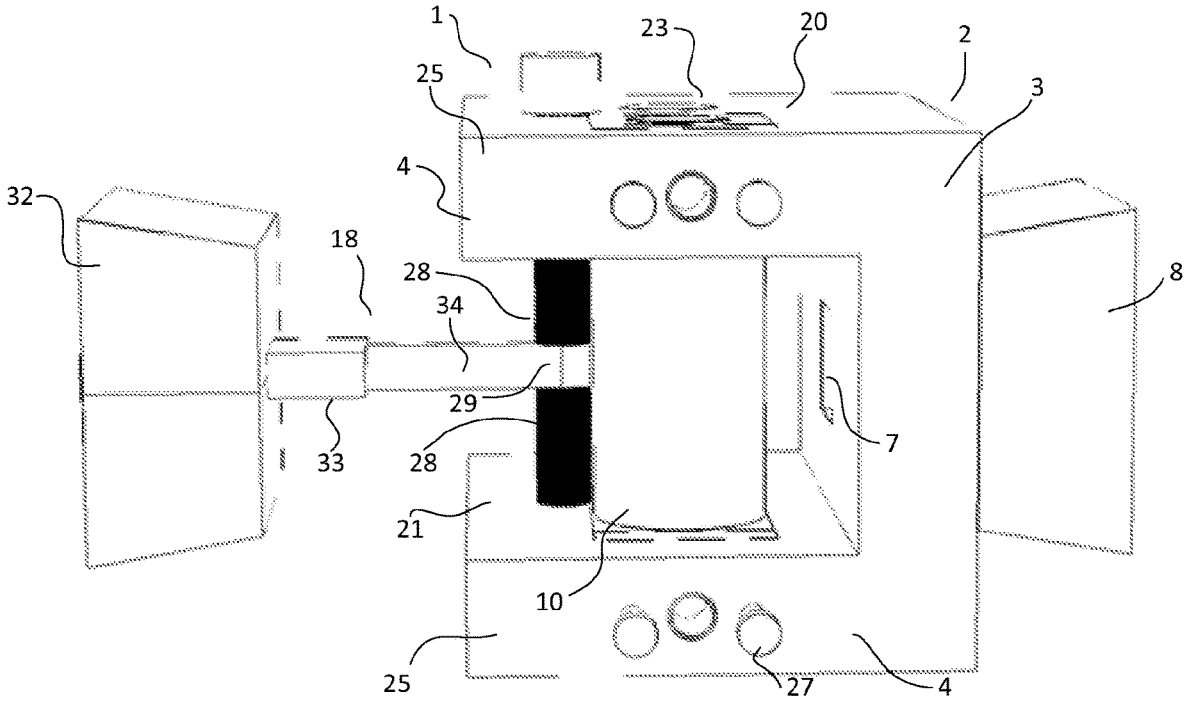
FIG. 1 (prior art) illustrates a top view of an embodiment of a rolling mill.
Figure 2:
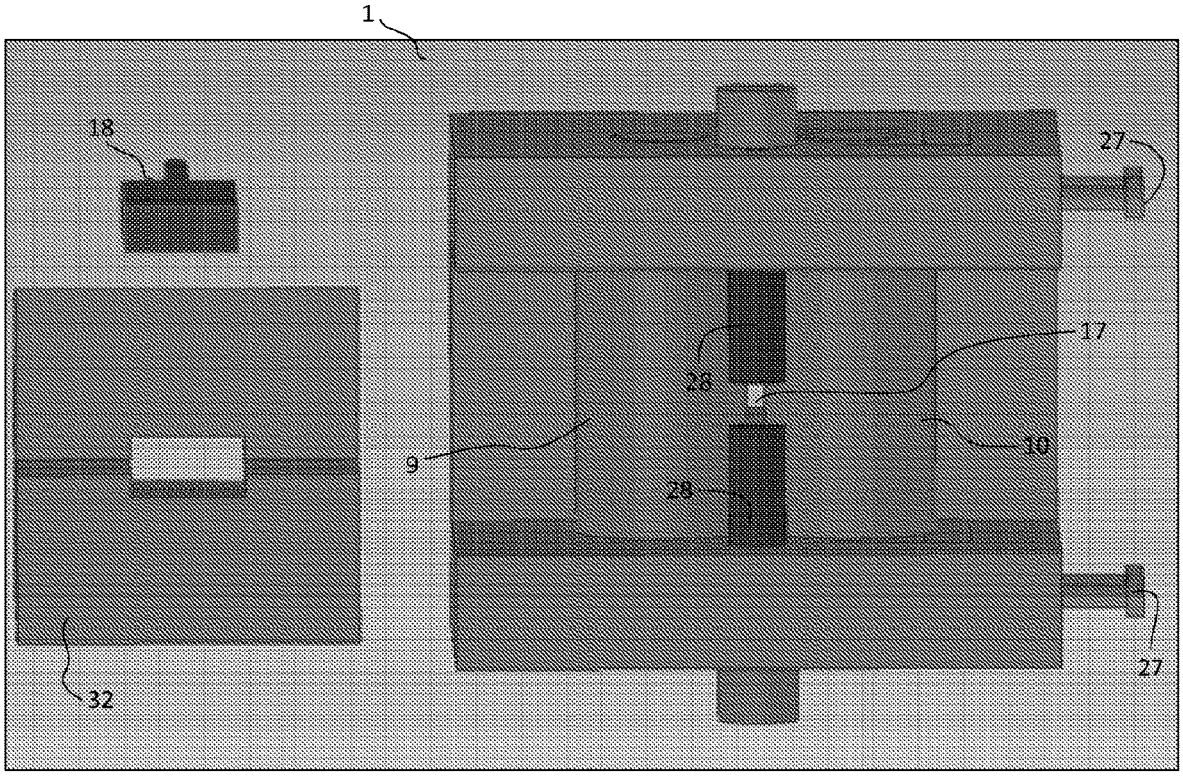
FIG. 2 illustrates an end view of the rolling mill of FIG. 1.
Figure 3:
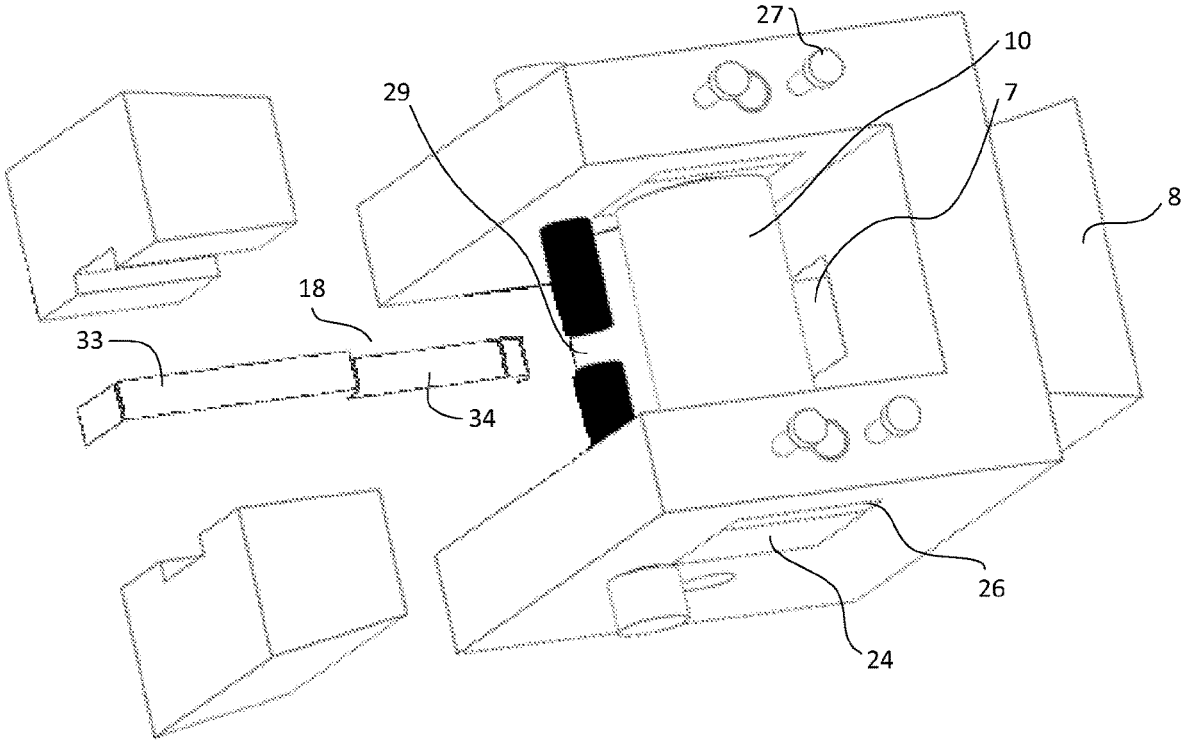
FIG. 3 illustrates a perspective view of the rolling mill of FIG. 1.

1 Rolling Mill
2 Housing
3 Rear Member of Housing
4 Side Member of Housing
5 Cavity in Side Member
6 Periphery of Cavity
7 Cavity in Rear Member
8 Coupling
9 First Roller
10 Second Roller
11 First Shaft
12 Second Shaft
13 First Roller Ring
14 Second Roller Ring
15 First Bearing Elements
16 Second Bearing Elements
17 Roll Gap
18 Workpiece
19 First recess
20 Outside surface of side member
21 Inside surface of side member
22 Second recess
23 Mounting Assembly
24 Bushing
25 Top surface of side member
26 Spacers
27 Locking Pins
28 Electrodes
29 Space Between Electrodes
30 First jaw
31 Second jaw
32 Grips
33 Grip portion of workpiece
34 Roll portion of workpiece

DETAILED DESCRIPTION

The following modes, given by way of example only, are described in order to provide a more precise understanding of the subject matter of a preferred embodiment or embodiments.

In the figures, incorporated to illustrate features of an example embodiment, like reference numerals are used to identify like parts throughout the figures.

Referring to the figures, shown is a rolling mill 1 suitable for use on a scale to conduct laboratory testing of the rolling process. The rolling mill 1 is particularly useful for use in conjunction with a thermal-mechanical simulator to control and monitor the rolling process. The rolling mill 1 is optimized for use with workpieces 18 at a high temperature, making the rolling mill 1 suitable for conducting hot rolling and hot stalling rolling trials. The rolling mill is also suitable for performing cold rolling tests.

The rolling mill 1 includes a housing 2, which in turn includes a rear member 3 with two side members 4 extending therefrom. The general profile of the housing is of a U-shape, with the two side members 4 opposing each other and connected at a periphery by the rear member 3. The housing 2 is a rigid structure, which provides a frame for other components of the rolling mill 1 to be mounted thereto. In an embodiment, the housing 2 may be formed of carbon steel.

A first roller 9 and a second roller 10 are mountable to the side members 4 such that they are located therebetween. The first roller 9 and the second roller 10 may be positioned with their axes in parallel, providing for a separation between the rollers termed the roll gap 17. By driving a workpiece 18 into the roll gap, the first roller 9 and second roller 10 will exert a force on the workpiece 18, thereby deforming the workpiece 18 between the two rollers 9, 10. The deformation of the workpiece 18 between the two rollers will reduce the thickness of the workpiece 18 to substantially the same size as the roll gap 17. Adjusting the positions of the rollers 9, 10 will adjust the size of the roll gap, and consequently, the resultant thickness of a workpiece 18 driven through the roll gap will also be adjusted.

Figure 4:
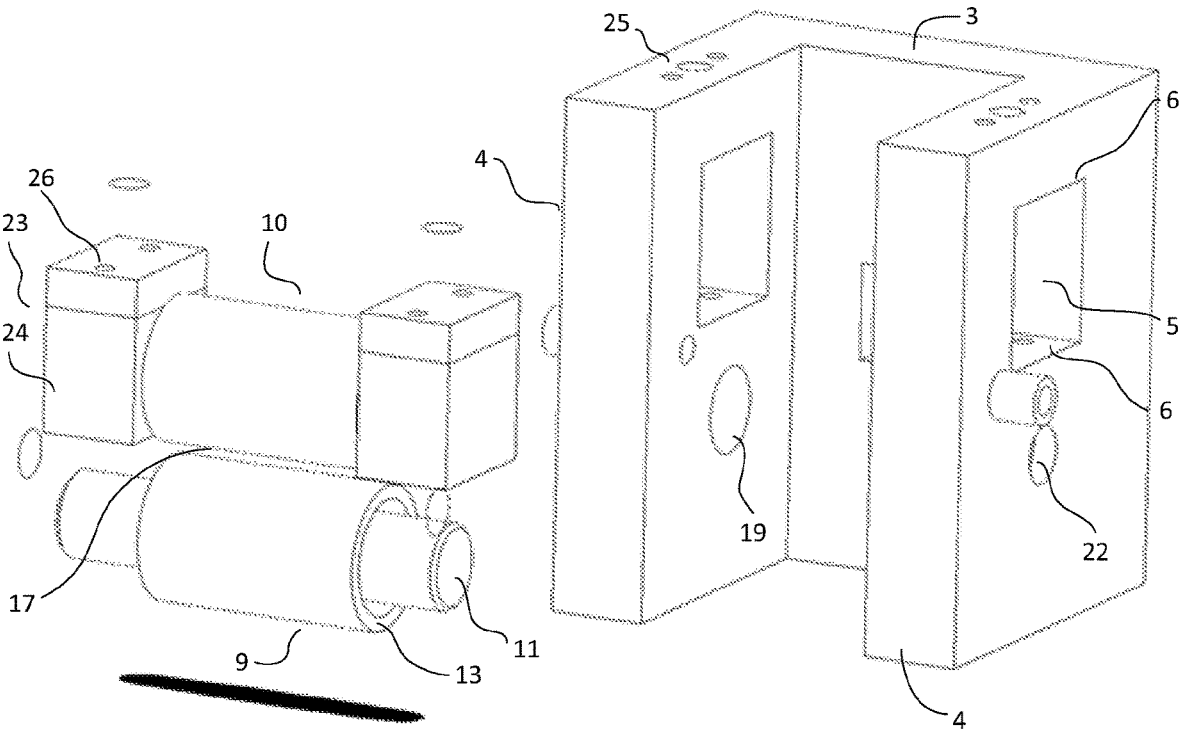
FIG. 4 illustrates a perspective view of the rolling mill of FIG. 1 with the rollers detached from the rolling mill.
Figure 5:
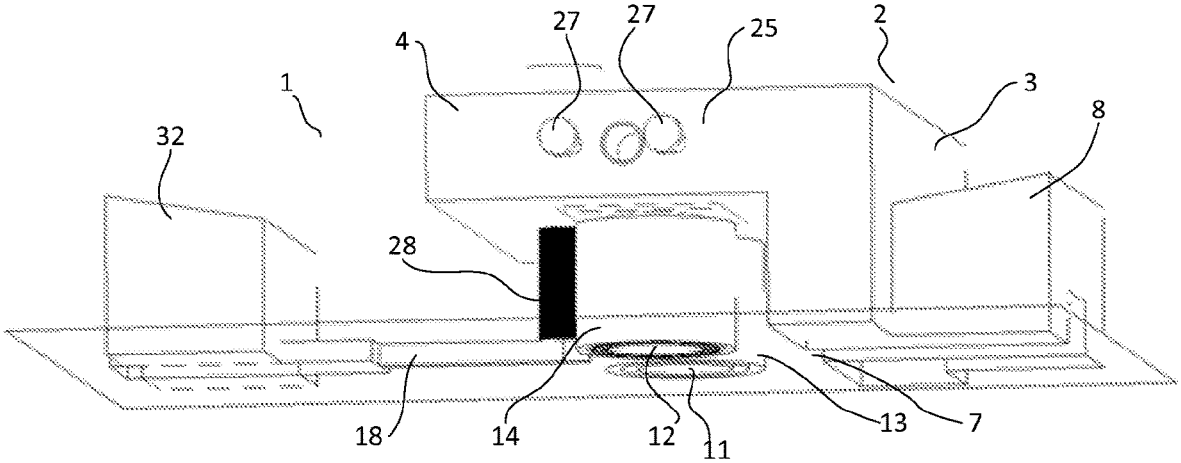
FIG. 5 illustrates a cutaway view of the rolling mill of FIG. 1.

As best depicted by FIG. 4, the first roller 9 and second roller 10 are comprised of a first shaft 11 and a second shaft 12 respectively. The shafts 11, 12 are configured to mount the side members 4 of the housing 2.

Disposed around the first shaft 11 and second shaft 12 are a first roller ring 13 and second roller ring 14 respectively. The roller rings 13, 14 are in the form of hollow cylinders with an internal diameter greater than the diameter of the shaft 11, 12 to which they are disposed around. By this arrangement, when the roller ring 13, 14 is disposed around the shaft 11, 12 coaxially, there will exist a space between the internal surface of the roller ring 13, 14 and the external surface of the shaft 11, 12. A first bearing element 15 and a second bearing element 16 may be located in this space or at least a portion of this space, between the roller ring 13, 14 and the shaft 11, 12 for the first roller 9 and the second roller 10, respectively. These bearing elements 15, 16 facilitate rotation of the roller rings 13, 14 around the shaft 11, 12. The external surface of the roller rings 13, 14 provides the rolling surface to deform the work piece 18. As the workpiece 18 is driven into the roll gap 17, interfacial friction between the roller rings 13, 14 and the work piece 18 may cause the roller rings 13, 14 to rotate as the workpiece 18 passes through the roll gap 17.

Separation of the roller ring 13, 14 from the roller shaft 11, 12 may provide for a barrier against heat transfer from the roller ring 13, 14 to the shaft 11, 12, thereby thermally decoupling the roller ring 11, 12 from the shaft 11, 12 to at least degree. This may reduce the amount of heat transfer from a hot workpiece 18 to the rollers 9, 10 during the rolling process, as the thermal mass in contact with the workpiece 18 is substantially limited to the roller ring 13, 14, rather than the entire roller 9, 10 including the shaft 11, 12. Otherwise stated, providing for a physical separation between the roller ring 13, 14 and the shaft 11, 12 may reduce heat absorbed by the roller ring 13, 14 being transferred to the shaft 11, 12, which in turn may reduce the amount of heat transferred by a hot workpiece 18 in contact with the rollers 9, 10.

Thermal decoupling of the roller ring 13, 14 from the shaft 11, 12 may be improved if the bearing elements 15, 16 are arranged away from the portion of the roller ring 13, 14 that contacts with the workpiece 18 during rolling. For example, if the workpiece 18 is rolled at a center portion of the rollers 9, 10, as depicted in the figures, the bearing elements 15, 16 may be positioned at an end portion of the rollers 9, 10, such that a space is provided between the roller ring 13, 14 and the shaft 11, 12 at the center portion of the roller 9, 10 with no bearing elements 15, 16 disposed therebetween. By providing for such a center portion that is sufficiently sized to accommodate the size of the workpiece 18, the workpiece 18 will only contact with the center portion as the workpiece 18 is being rolled.

However, even if the bearing elements 15, 16 are located between the roller ring 13, 14 and the shaft 11, 12 at the portion of the roller 9, 10 which contacts with the workpiece 18 during rolling, heat transfer through the bearing elements 15, 16 to the shaft 11, 12 may be limited, such that the workpiece 18 may be substantially decoupled from the thermal mass of the shaft 11, 12. This reduced heat transfer may be due in part to the minimal contact required between the bearing elements 15, 16 and both the roller ring 13, 14 and the shaft 11, 12.

Furthermore, the roller ring 13, 14 may be configured with a narrow width compared to its overall diameter. For example, in the embodiment shown in FIG. 4, the width of the roller ring 13, 14 is much less than the overall diameter of the roller ring 13, 14 and the diameter of the shaft 11, 12. Such an arrangement of the width compared to the overall diameter roller ring 13, 14 may provide for a roller ring 13, 14 with a comparatively lower mass and hence a small thermal mass to absorb heat from a hot workpiece 18, thereby reducing heat transfer from the workpiece 18 when the workpiece is in contact with the rollers 9, 10.

Providing for a roller ring 13, 14 with a relatively low mass may also be beneficial when performing hot stalling rolling test. When a workpiece 18 is moved into the roll gap 17, interfacial friction between the workpiece 18 and the roller rings 13, 14 will cause the roller rings to rotate. As the wall width of the roller rings 13, 14 are small compared to the overall diameter, the roller rings are configured with a relatively low mass and hence, the roller rings 13, 14 will carry less momentum as they rotate compared with heavier rollers. By configuring the roller rings 13, 14 with a sufficiently low mass, when the movement of the workpiece 18 is stalled in the roll gap 17, interfacial friction between the workpiece 18 and the first and second roller rings 13, 14 is sufficient to pause the rotation of the roller rings 13, 14 without substantial further rotation.

In embodiments of the rolling mill 1 suitable for use in conjunction with a Gleeble 3500 thermal-mechanical simulator, the roller rings 13, 14 may have an internal diameter of 24 mm and an external diameter of 30 mm and therefore a will thickness (width) of 6 mm. The ratio of the width to the external diameter of such an embodiment would be 0.2 and the ratio of the internal diameter to the external diameter would be 0.8. Other ratios of internal diameter to external diameter suitable to provide for a roller ring with comparatively low mass and low thermal mass may be substantially between 0.7 to 0.9 or thereabout. In certain embodiments suitable for rolling steel or stainless steel, the roller rings 13, 14 may be formed of high speed steel.

In the embodiment of the figures, a first recess 19 and a second recess 22 are provided to mount the first roller 9 to the housing 2. The size and shape of the first recess 19 may be configured in sympathy with the diameter of the first shaft 11 so that minimal play exists around the shaft 11 when it is positioned in the recess 19. Providing for a first recess 19 sized to accommodate the first shaft 11 with minimal play may restrict axial movement of the first shaft 11. This in turn may reduce deflection of the first roller 9 during the rolling process.

To assemble the first roller 9 in place within the housing 2, an end of the shaft 11 is aligned with the first recess 19 from the outside surface 20 of a side member 4. The shaft 11 is then pushed through the first recess 19 until a portion of the shaft emerges from the first recess 19 at the inside surface 21 of the side member 4. The bearing elements 15 and the roller ring 13 may then be arranged around the portion of the shaft 11 protruding from the inside surface 21 of the side member 4. With the bearing elements 15 and the roller ring 13 aligned in position around the shaft 11, the shaft 11 can be pushed further through the first recess 19 until an end of the shaft 11 locates in the second recess 22, which may also be sized to accommodate the first shaft with a minimum of play to restrict axial movement. In doing so, the shaft 11 will extend all the way through the roller ring 13, thereby positioning the roller ring 13 between the two side members 4 with both ends of the shaft located in a recess 19, 22.

In an embodiment, the second recess 22 may be configured to extend all of the way through the side member 4. By this arrangement, the first shaft 11 can be simply dismounted from the housing by pushing an end of the shaft through either of the recesses 19, 22 from the outside surface 20 of the side member 4.

In an alternative arrangement, the second recess 22 may be configured to extend only part way through the side member 4. Then, when the first shaft 11 is pushed through the first recess 19 until an end of the first shaft 11 locates in the second recess 22, the first shaft 11 will abut against the second recess 22, such that the first shaft 11 cannot be pushed all the way through the second recess 22. This arrangement may help the first shaft 11 remain mounted to the housing 2 and prevent any slippage of the first shaft 11 which may cause the first shaft 11 to dis-mount from the housing 2. It may also be beneficial to provide an extension of the second recess 22 that continues all the way through the side member 4, but is of a smaller diameter than the first shaft 11. By this arrangement, an elongated member may be inserted into the extension from the outside surface 20 of the side member 4 to push against the first shaft 11 mounted in the second recess 22. This may cause the shaft 11 to dis-mount from the second recess 22, facilitating the easy removal of the first roller 9 from the housing 2.

In the embodiments of the figures, the shaft 11 is sized so that the ends of the first shaft 11 are substantially flush with the outside surface 20 of the side member when the first roller is mounted to the housing 2. In other embodiments, one or both ends of the first shaft 11 may be configured to protrude from the outside surface 20 and be adapted with split pins or a similar device to help prevent the shaft 11 from slipping out of the recess 19, 22 which may lead to the shaft becoming dislodged from the housing 2.

Mounting the first roller 9 to the housing 2 by the recesses 19, 22 will fix the position of the first roller 9 relative to the housing 2. In order to adjust the roll gap 17 the position of the second roller 10 is configured to be adjustable in position relative to the housing 2. In the embodiment of the figures, a mounting assembly 23 is provided for each end of the second roller 10 in order to adjustably mount the second roller 10 to the housing 2.

The mounting assembly 23 includes a bushing 24 adapted to couple with an end of the shaft 12. The bushing 24 is configured to removably seat within a cavity 5 in a side member 4. In the embodiment of the figures, the bushing 24 is of a block shape with a recess to accommodate an end of the second shaft 12, though other bushing shapes are possible. The bushing 24 is sized to fit securely within the cavity in a first axis towards and away from the rear member 3 of the housing 2. The bushing 24 is also sized to fit loosely in a second axis which is orthogonal to the first axis. By this arrangement, when the bushing 24 is seated in the cavity 5, the bushing 24 is substantially constrained in direction towards and away from the rear member 3, but can be moved in a direction towards and away from the top surface 25 of the side member 4

To mount the second roller 9 to the housing, the second bearing elements 16 and the second roller ring 14 are arranged around the second shaft 12 as herein before described. The shaft 12 can then be coupled with a bushing 24 at either end, and slid into a mounted position with the bushings 24 seated within the cavities 5.

When the second roller 10 coupled with the bushings 24 is mounted to the cavities 5 of the side members 4, the bushings 24 are able to move within the cavities as hereinbefore described such that the second roller 10 arranged between the bushings 24 can move towards and away from the top surface 25 of the side members 4. Consequently, when the first roller 9 is mounted to the housing 2, the second roller 10 can be moved towards and away from the first roller 9, thereby setting the size of the roll gap 17, between the two rollers 9,10.

To fix the position of the second roller 10 and hence the roll gap 17, the mounting assembly 23 includes one or more spacers 26, that can be inserted between the bushing 24 and a periphery 6 of the cavity 5. The size and placement of the one or more spacers 26 within the cavity 5 may remove play from around the bushing 24 such that the bushing 24 is constrained from movement within the cavity 5. By this arrangement, the second roller 10 may be fixed in position with a set roll gap 17 between the first roller 9 and the second roller 10, thus providing a fixed roll gap 17. The placement of one or more spacers 26 of different sizes and/or at different positions within the cavities allows for the easy adjustment of the roll gap 17. Furthermore by removing and replacing the mounting assembly 23 and inserting the same sized one or more spacers 26 into the same position within the cavities 5, the roll gap 17 will be configured with the same size. By this arrangement, the second roller can be mounted and dismounted from the housing as required with a roll gap that is constant in size, making for subsequent rolling trials with a repeatable set-up.

The mounting assembly 23 also includes one or more locking pins 27 which may help secure the bushings 24 and the one or more spacers 26 in position within the cavity 5, thus helping to minimize any movement of the mounting assembly 23 or deflection of the second roller 10 during the rolling process. In the embodiment of the figures, the one or more locking pins 27 are in the form of bolts that may screw into the housing 2 from a top surface 25 of the side members 4. By screwing the one or more locking pins 27 into the housing 2, the locking pins 27 may protrude into the cavity 5, and apply a force against the one or more spacers 26 and the bushings 24 mounted therein, thus helping to secure the one or more spacers 26 and bushings 24 in place within the cavity 5. Generally, the size and position of the one or more spacers 26 within the cavities 5 would be configured to substantially remove all play from the position of the bushings 24 within the cavities 5. By this arrangement, the locking pins 27 would only be required to protrude minimally into the cavities 5 in order to apply a retaining force to the bushings 24 and the one or more spacers 26 to keep the arrangement of the spacers 26 and bushings 24 in place within the cavities 5 to prevent dislodgement therefrom.

The mounting assembly 23 facilitates quick mounting, dis-mounting and adjustment of the second roller 10 to the rigid structure of the housing 2. It also facilitates quick adjustment of the roll gap 17. The ability of the mounting assembly 23 to quickly facilitate dismounting of the second roller 10 is particularly useful when performing hot stalling rolling tests using the rolling mill 1. Once the workpiece 18 is driven into the roll gap 18 and stalled, the workpiece 18 may be easily retrieved by loosening the locking pins 27 and sliding the one or more spacers 26 out of the cavities 5 in the side members 4. The bushings 24 will then be able to slide along the second axis, thus allowing the coupled second roller 10 to move away from the first roller 9. Moving the second roller 10 away from the first roller 9 will increase the roll gap 17, allowing the stalled workpiece 18 to be retrieved without the workpiece 18 having to be passed back through the roll gap 17, which may affect the surface morphology of the workpiece 18. The rolling mill 1 may then be quickly re-assembled by sliding the one or more spacers 26 back into the cavities 5 to set the roll gap 17 as required and tightening the locking pins 27 to hold the mounting assembly 23 in place. As the spacers 26 are fixed in size, putting the same one or more spacers 26 back into position within the cavity 5 will lead to the rolling mill 1 being configured with the same roll gap 17. Alternatively, the first roller 9 may be dismounted from the housing 2 as hereinbefore described to release the stalled workpiece 18. The ability to quickly adjust the position of the second roller 10 may minimize the time required to perform subsequent rolling tests compared to conventional laboratory mill, which are often time consuming to set-up and adjust. The arrangement of the mounting assembly 23 also allows the second roller 14 to be mounted/dismounted or adjusted in position without interfering with the first roller 9 or the housing 2. Adjustment of the second roller 10 and hence the roll gap 17 can be performed without interfering with the first roller 9 or the overall housing 2.

Protruding from each of the side members 4 of the housing 2 are an electrode 28. The electrodes 28 are configured to protrude from the side members 4 towards each other, thereby defining a space 29 between the electrodes 28. The space 29 between the electrodes 28 is configured to receive the workpiece 18 to be rolled, such that positioning of the workpiece 18 within the space 29 completes an electrical circuit between the electrodes 28. Passing a current though this circuit may cause the workpiece 18 to be electrically heated, thereby raising the temperature of the material 18.

As best depicted by FIG. 4, the space 29 between the electrodes 28 is adjacent to the roll gap 17. By this arrangement, a workpiece 18 can be placed within the space 29 between the electrodes 28 to be heated, and subsequently be thrust forward into the roll gap 17 to roll the workpiece 18. The close placement of the space 29 between the electrodes 28 and the roll gap 17 may allow the workpiece 18 to be driven into the roll gap 17 very shortly after the work piece 18 is heated by the electrodes 28. Minimizing the time between heating and rolling the workpiece 18 may minimize heat transfer from the workpiece 18 which may adversely affect the rolling process. Excessive heat transfer from the workpiece 18 prior to rolling may also lead to a non-homogeneous temperature profile. Heating the workpiece 18 in place immediately before rolling, without any additional handling of the sample, may be particularly advantageous in preventing heat transfer from the workpiece 18 in a hot rolling or hot stalling rolling process, as these processes may require the workpiece 18 to be heated to temperatures up to and exceeding 1100° C. The ability of the rolling mill 1 to facilitate the rolling process at such high temperatures allows for certain types of stainless steel and other materials requiring high temperatures to undergo hot rolling.

The electrodes 28 may be formed from tungsten carbide, graphite, or any other suitable material. Graphite sheets may be placed between the electrodes 28 and the workpiece 18 in order to minimize friction. Depending on the current passed between the electrodes 28, the workpiece 18 may be heated up to 1100° C., or more. In order to measure the temperature of the workpiece 18 as it is being heated by the electrodes 28, thermocouples can be placed on the workpiece 18. Placement of the thermocouples can be made at various points along the workpiece 18 to measure any temperature distribution.

The design of the rolling mill 1 allows the mill to be configured in a compact size that is quick and simple to assemble and disassemble, making the rolling mill suitable for use in a thermal-mechanical simulator such as a Gleeble 3500. The Gleeble 3500 thermal-mechanical simulator is a fully integrated digital closed loop control thermal and mechanical testing system, which provides an accurate execution and repeatable test program. The machine typically has a high speed heating system, a servo hydraulic system and a computer control and data acquisition system. The high speed heating systems can heat specimens at a rate of up to 10,000° C./s and can hold steady-state equilibrium temperatures. A servo hydraulic system can generate impacts of up to 100 KN of static force in tension or compression, with a displacement rate as fast as 1000 mm/s. The computer control and data acquisition system can program the process schedule, and then the software can calculate and program how to conduct the schedule. The persecuted data can be monitored and collected by the software.

The Gleeble 3500 has a test chamber, a load cell and as well as temperature and displacement sensors, allowing the Gleeble to collect data of force, strain, stress, stroke and real temperature in the rolling process. The test chamber can also be configured with varying atmosphere, such as humidity.

Figure 7:
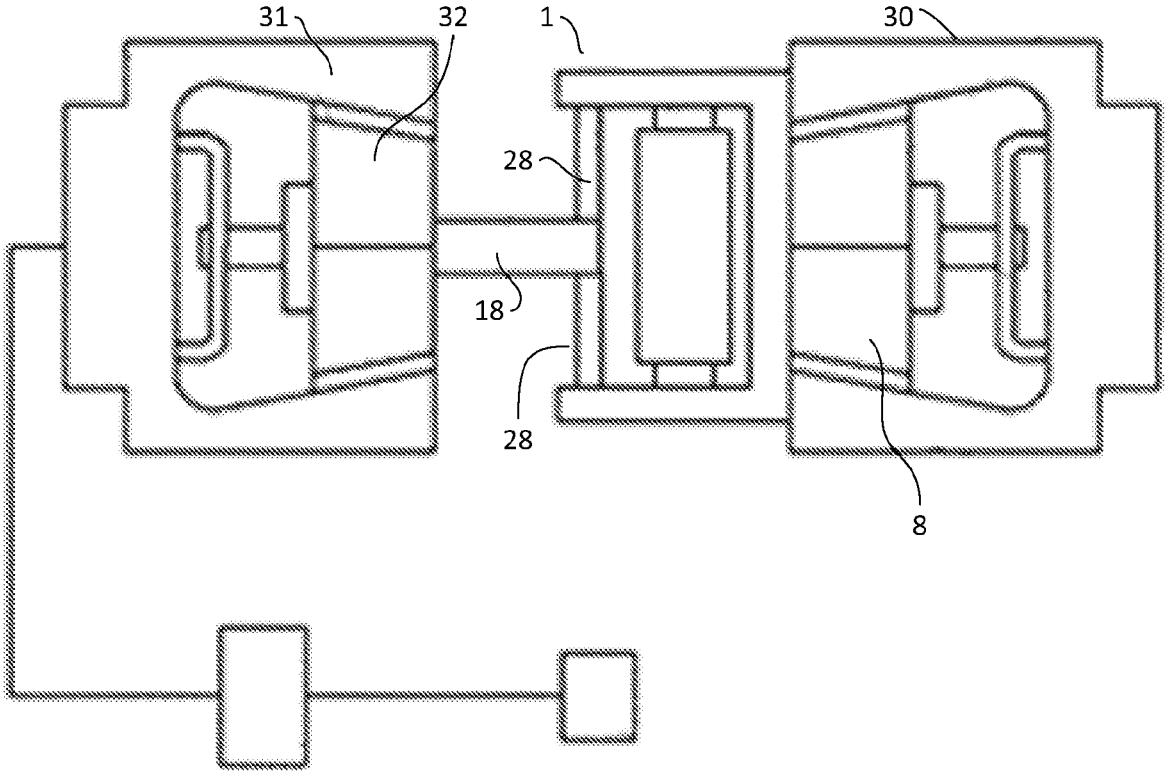
FIG. 7 illustrates a schematic of an embodiment of the rolling mill coupled with a thermal-mechanical simulator.
Figure 8:
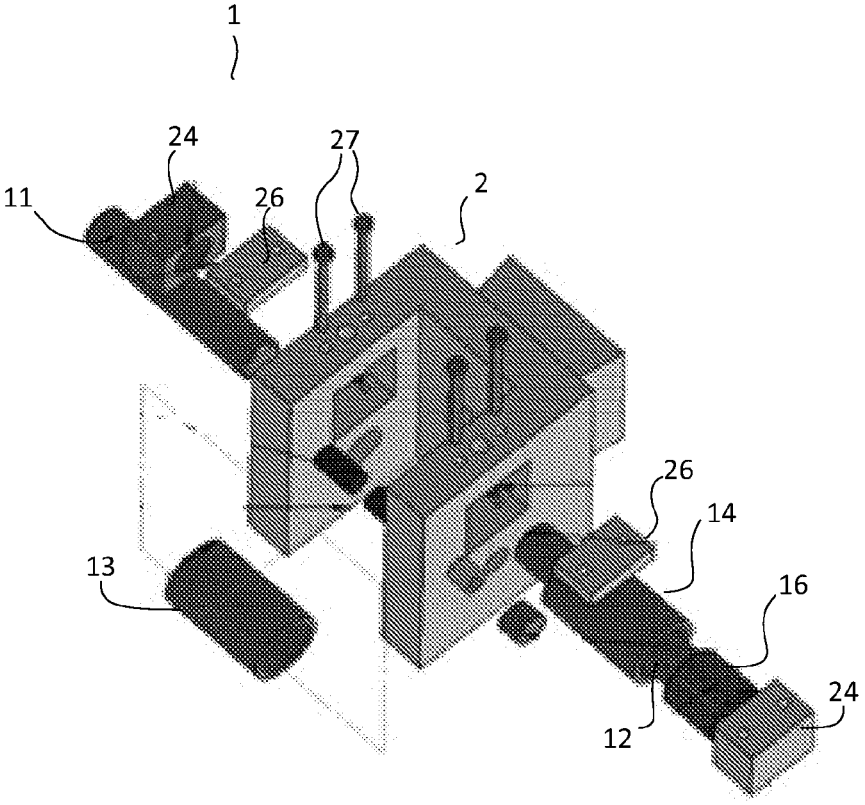
FIG. 8 illustrates an exploded view of an embodiment of the rolling mill.

To facilitate the use of the rolling mill 1 with a thermal-mechanical simulator, the housing can be adapted with a coupling 8 on the rear member 3 of the housing 2. A first jaw 31 within the test chamber of a thermal-mechanical simulator can latch onto the coupling 8 as depicted in FIG. 7, thus securing the housing 2 within the test chamber of the thermal-mechanical simulator. In the embodiment depicted, the coupling 8 is has a generally trapezoidal shape which adapts to a corresponding profile of the first jaw 30, though other arrangement are equally feasible.

Similarly, the workpiece 18 may be secured by grips 32 that are adapted to couple with a second jaw 31 within the test chamber of a thermal mechanical simulator. The second jaw 31 of the thermal-mechanical simulator may be actuated hydraulically or by some other means such that the second jaw 31 can be moved forward, thereby driving the workpiece 18 into the roll gap 17. Movement of the second jaw 31 may be computer controlled and adjustable in terms of the force applied and the rolling speed, allowing these parameters to be studied in experimental trials. Movement of the second jaw 31 may also be computer controlled to halt the motion of the workpiece 18 before it had passed entirely through the roll gap 17, allowing hot stalling rolling trials to be performed.

Figure 6:
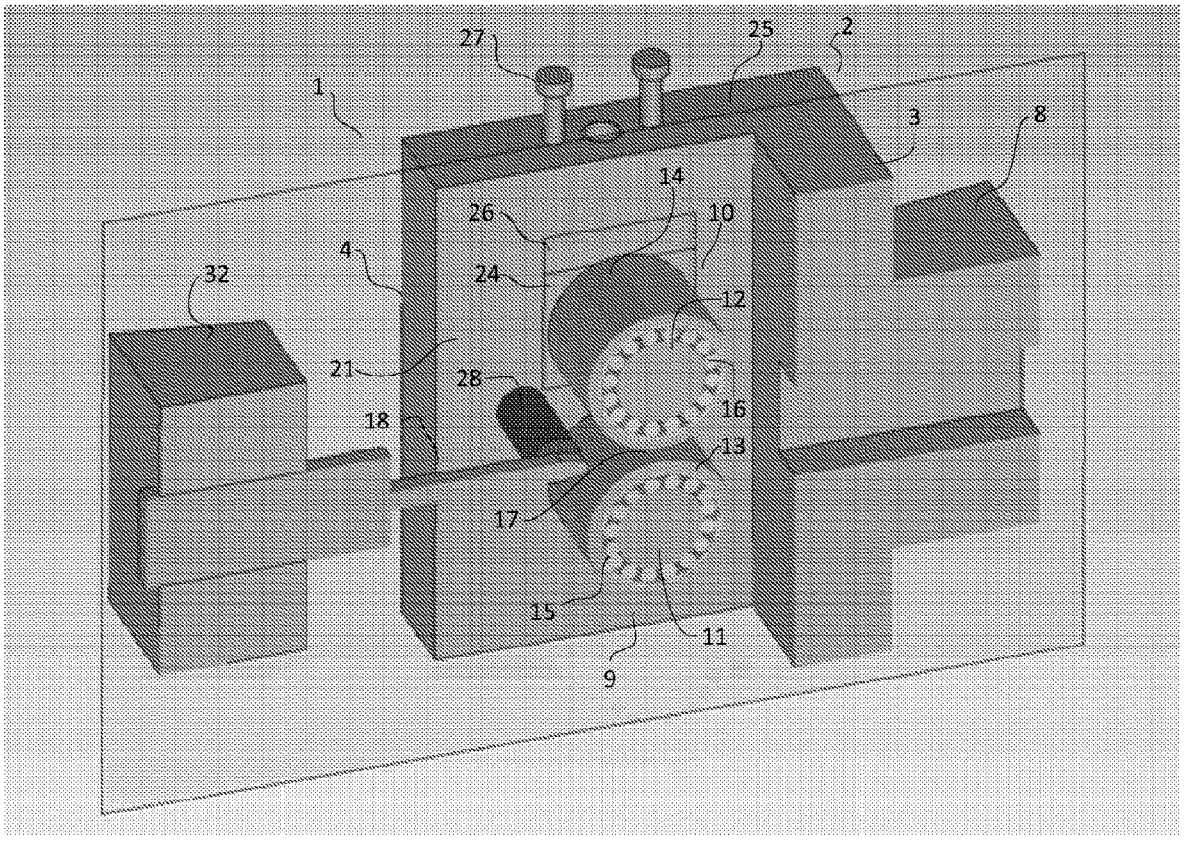
FIG. 6 illustrates an alternative cutaway view of the rolling mill of FIG. 1.

A cavity 7 in the rear member 3 of the housing 2 may be provided to accommodate the workpiece 18 as it passes through the roll gap 17 in a direction towards the rear member 3. The cavity 7 may extend through the coupling 8 adapted to the rear member 3 if necessary to accommodate the size of the work piece 18. The cavity 7 extending through the rear member 3 and the coupling 8 is depicted in FIG. 6. The provision of the cavity 7 to accommodate the workpiece 18 as it is driven through the roll gap 17 reduces the amount of offset required between the rollers 9, 10 and the rear member 3 that may otherwise be needed to prevent the workpiece 18 being obstructed by the rear member 3 as it is passed through the roll gap 17. This may allow the workpiece 18 to undergo a larger displacement through the roll gap 17 than may otherwise be possible, providing for a resultant workpiece with a larger section that has been deformed by the rollers 9, 10, and thus a larger specimen to conduct examination of the deformed workpiece. Minimizing the physical space occupied by the rolling mill 1 may provide an advantage in containing the rolling mill 1 within the often limited space of a test chamber of a thermal-mechanical simulator. It may also provide enough space in the test chamber such that the workpiece can be heated without being in contact with the rollers, as depicted in FIG. 6, for example. Heating the workpiece 18 without being in contact with the rollers 9, 10 may allow the workpiece 18 to be heated to higher temperatures, as heat would not be lost through heat transfer with the rollers 9, 10.

As shown in FIG. 1, for example, the workpiece 18 adapted for use with a thermo-mechanical simulator may take the form of an elongate member with varying dimensions over its length. In the depicted embodiment the width of the workpiece 18 is substantially constant, but the height of the sample varies between ends. At one end is a grip portion 33 with a larger height configured to be held by the grips 32. At the other end is a roll portion 34 which will undergo deformation by the rollers 9, 10. Although the depicted embodiments show a square shoulder between the roll portion 34 and the grip portion 33, it has been found that a rounded concave shoulder may lead to a more uniform temperature distribution along the workpiece 18 when it is heated. The roll portion 34 is substantially uniform in cross section which may facilitate the roll portion achieving a substantially uniform temperature when heated to high temperatures in excess of 1000° C.

In an embodiment suitable for use with a Gleeble 3500 thermal mechanical simulator, the rolling mill 1 may be configure with a housing with dimensions of approximately 115 mm length, 130 mm width and 110 mm height. Such a housing 2 may adapted with rollers 9, 10 with an external diameter of about 30 mm and a length of about 50 mm. A rolling mil 11 of these dimensions occupies a sufficiently small volume such that the rolling mill can be situated in the limited space of the test chamber of the Gleeble whilst providing enough space for the workpiece 18 to be heated without contacting the rollers 9, 10, and whilst also providing for an arrangement where the available driving displacement of the workpiece 18 through the roll gap 17 is large enough to produce a rolled workpiece 18 with a large enough deformed portion for examination, i.e. a driving displacement of greater than at 10 mm.

Although the described embodiments are suitable for a small rolling mill sized for use in conjunction with a thermal-mechanical simulator, the rolling mill is equally suitable for use on a larger scale such as conventional laboratory rolling mills.

Many modifications will be apparent to those skilled in the art without departing from the scope of the present disclosure.

The invention claimed is:

1. A rolling mill suitable for performing hot stalling rolling, including:

a housing;

a first roller mountable to the housing;

a second roller mountable to the housing;

a roll gap between the first roller and the second roller;

a mounting assembly, wherein the mounting assembly is configured such that a position of the second roller relative to the housing is adjustable, thereby adjusting a width of the roll gap between the first roller and the second roller, and wherein when a workpiece is passed through the roll gap, the workpiece is deformed by the first and second rollers; and two electrodes protruding from opposing portions of the housing thereby defining a first space therebetween, wherein the first space between the two electrodes is adjacent to the roll gap, and wherein the first space between the two electrodes is configured to receive the workpiece to complete a circuit between the two electrodes such that passing a current between the two electrodes causes the workpiece to heat.

2. The rolling mill according to claim 1, wherein the first roller is fixed in position relative to the housing when mounted thereto.

3. The rolling mill according to claim 1, wherein the housing includes a rear member with a cavity such that when the workpiece is passed through the roll gap, the workpiece protrudes into the cavity.

4. The rolling mill according to claim 1, wherein the electrodes heat the workpiece without contacting the first roller or the second roller.

5. The rolling mill according to claim 1, wherein the two electrodes can heat the workpiece to a temperature in excess of 1100° C.

6. The rolling mill according to claim 1, wherein each of the first roller and the second roller includes:

a shaft; and, a roller ring in a form of a hollow cylinder configured to rotate around the shaft.

7. The rolling mill according to claim 6, wherein:

the roller ring includes an inside surface, and the shaft includes an outer surface, and wherein a second space is provided between the inside surface of the roller ring and the outer surface of the shaft.

8. The rolling mill according to claim 6, further including:

one or more bearing elements which are located between the shaft and the roller ring of each of the first and second rollers.

9. The rolling mill according to claim 8, wherein each of the first roller and the second roller includes a center portion, and the one or more bearing elements are located away from the center portion of the respective first and second rollers.

10. The rolling mill according to claim 9, wherein the center portion of each of the first and second rollers is sized to accommodate the workpiece.

11. The rolling mill according to claim 6, wherein interfacial friction between the workpiece and the roller rings of the first and second rollers causes the roller rings of the first and second rollers to rotate as the workpiece is moved through the roll gap; and wherein each of the roller rings of the first and second rollers includes a mass which is configured such that when movement of the workpiece through the roll gap is paused, interfacial friction between the workpiece and the roller rings of the first and second rollers pauses rotation of the roller rings of the first and second rollers without further rotation.

12. The rolling mill according to claim 6, wherein a ratio of an inner diameter to an outer diameter of the first roller and the second roller is between about 0.7 and about 0.9.

13. The rolling mill of claim 1, wherein the second roller has two ends, each end is provided with the mounting assembly, and the housing includes a receiving cavity, wherein each mounting assembly is configured to mount within the receiving cavity.

14. The rolling mill according to claim 13, wherein each mounting assembly includes:

a bushing mounted to a shaft of the second roller; and one or more spacers removably located between the bushing and a periphery of the receiving cavity such that a position of the second roller is adjustable relative to the housing via the one or more spacers.

15. The rolling mill according to claim 14, including:

one or more locking pins which retractably extend into the receiving cavity, the one or more locking pins sized and shaped to assert a force to the bushing and the one or more spacers.

* * * * *